US010699826B1

(12) United States Patent
Lin

(10) Patent No.: US 10,699,826 B1
(45) Date of Patent: Jun. 30, 2020

(54) CABLE STRUCTURE

(71) Applicant: Jyh Eng Technology Co., Ltd., New Taipei (TW)

(72) Inventor: Yen-Lin Lin, New Taipei (TW)

(73) Assignee: JYH ENG TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 16/534,883

(22) Filed: Aug. 7, 2019

(51) Int. Cl.
*H01B 11/08* (2006.01)
*H01B 11/10* (2006.01)

(52) U.S. Cl.
CPC ..... *H01B 11/08* (2013.01); *H01B 11/10* (2013.01)

(58) Field of Classification Search
CPC ..... H01B 11/08; H01B 11/10; H01B 11/04; H01B 11/02; H01B 11/06; H01B 11/005
See application file for complete search history.

(56) References Cited

U.S. PATENT DOCUMENTS

| | | | | |
|---|---|---|---|---|
| 7,772,494 | B2 | 8/2010 | Vexler et al. | |
| 7,897,875 | B2 | 3/2011 | Gareis | |
| 2004/0055781 | A1* | 3/2004 | Cornibert | H01B 11/06 174/135 |
| 2009/0173514 | A1* | 7/2009 | Gareis | H01B 11/06 174/113 R |

FOREIGN PATENT DOCUMENTS

JP P2004-311120 A 11/2004

* cited by examiner

*Primary Examiner* — Timothy J Thompson
*Assistant Examiner* — Amol H Patel
(74) *Attorney, Agent, or Firm* — Guice Patents PLLC

(57) ABSTRACT

A cable structure includes a tubular body, a main spacer, a first spacer, a first protector, a second protector and a plurality of twisted pairs. The tubular body is disposed in the tubular body. The first spacer is substantially perpendicularly connected to the main spacer in a central position. The first protector and the second protector are disposed at two ends of the main spacer. A first channel is formed by the main spacer, the first protector and the second protector, a second channel is formed by the main spacer, the first protector and the first spacer, and a third channel is formed by the main spacer, the second protector and the first spacer. The twisted pairs are disposed in the first channel, the second channel and the third channel.

12 Claims, 5 Drawing Sheets

CABLE STRUCTURE

BACKGROUND OF THE INVENTION

Field of the Invention

The invention relates to a cable, and more particularly to cable having an anti-crosstalk structure.

Description of the Related Art

In a network system, a network cable is used for signal transmission to a device connected to the network system. The more network develops, the transmission speed of signals via the network cable is also required to be faster. Therefore, the current network construction environment tends to be densely arranged, and the network cable that is laid out will also tend to have a tight structure.

Since electromagnetic waves are emitted from the core wires of each network cable when signals are transmitted in the network cable, it is needed to isolate or reduce the electromagnetic waves emitted by other core wires to improve the transmission efficiency in the network cable without affecting the signal transmitted therein.

In order to solve this problem, the prior art, such as the U.S. Pat. No. 7,772,494, discloses a structure of an isolation bracket, which is formed by combining two H-shaped brackets in a misalignment manner and forming four isolation channels. Each of the four twisted pairs in a network cable are respectively received in an isolation channel, and the spacers are used to reduce the mutual interference between the four pairs of twisted pairs. Two bumps are additionally disposed on the two spacers on the outer side of the H-shaped bracket. When the plurality of network cables are close to each other, the two adjacent network cables can be separated by the bumps. Although the bracket can effectively block four Crosstalk interference between twisted pairs, and can also effectively prevent crosstalk interference with external network cables, it also produces reduction of the complementary effect between the complementary twisted pairs due to the isolation structure. At the same time, it costs more for the cross-shaped isolation bracket which is a more conventional art.

In addition, a conventional T-shaped isolation bracket is disclosed in the prior art, such as Japan patent publication No. P2004-311120A. The T-shaped structure is divided into three core channels, and two of the four twisted pairs of network cables are received in one of the channels, and the other two twisted pairs are received in the rest two channels respectively. Similarly, a conventional technique such as U.S. Pat. No. 7,897,875 discloses a T-isolated bracket based on the contents of the aforementioned Japan patent. It is further disclosed that the twisted pair having the second longest pitch and the twisted pair having the shortest pitch are received in the same channel, and the twisted pair having the longest pitch and the twisted pair having the second shortest pitch are received in the rest two channels respectively. Although the aforementioned T-shaped bracket further has no separation for the complementary twisted pairs, so that the signals in the complementary twisted pairs can complement each other, and can also isolate the crosstalk of the remaining twisted pairs, such a structure cannot effectively avoid the crosstalk interference caused by the external network cable, which is the shortcoming of this technology.

BRIEF SUMMARY OF THE INVENTION

In view of the above-mentioned shortcomings, an object of the present invention is to provide a cable structure with an isolation bracket, which is arranged by internal spacers and protectors to prevent crosstalk interference with adjacent cable. It effectively enhances the ability of external crosstalk, and at the same time, the plurality of core wires of the twisted pairs disposed in the same channel also complement each other.

The invention provides a cable. The cable in accordance with an exemplary embodiment of the invention includes a tubular body, a main spacer, a first spacer, a first protector, a second protector and a plurality of twisted pairs. The tubular body is disposed in the tubular body. The first spacer is disposed in the tubular body and substantially perpendicularly connected to the main spacer at a central position. The first protector is disposed at an end of the main spacer and connected to the main spacer at an angle. The second protector is disposed at another end of the main spacer and connected to the main spacer at an angle, wherein a first channel is formed by the main spacer, the first protector and the second protector, a second channel is formed by the main spacer, the first protector and the first spacer, and a third channel is formed by the main spacer, the second protector and the first spacer. The twisted pairs are disposed in the first channel, the second channel and the third channel, wherein an even number of the twisted pairs are received in the first channel, one of the twisted pairs is received in the second channel and another one of the twisted pairs is received in the third channel.

The first protector and the second protector can respectively fix the twisted pairs to the first channel, the second channel and the third channel. The first protector and the second protector can respectively prevent the crosstalk caused by the adjacent cable. The main spacer and the first spacer are arranged to isolate the interference caused by the twisted pair disposed on the first channel, the second channel and the third channel respectively. The plurality of core wires disposed in the twisted pairs of the same channel have complementary effect respectively.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
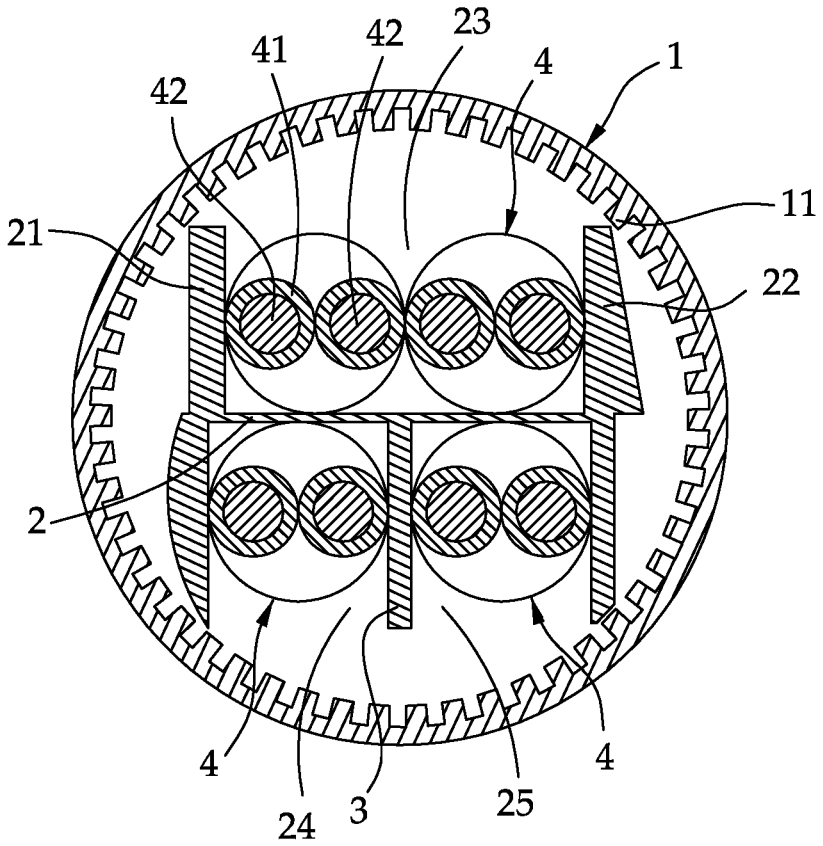
FIG. 1 is a cross-sectional view of a first embodiment of a cable structure of the present invention.

Referring to FIG. 1, which is a cross-sectional view of the first embodiment of a cable of the present invention. As shown in FIG. 1, the cable structure of the present invention includes a tubular body 1 in which a main spacer 2 is disposed. The main spacer 1 is horizontally located therein, and a first spacer 3 is connected to the main spacer 2 at a central position of the main spacer 1 in the embodiment. The first spacer 3 is connected to the main spacer 2 in a vertical manner, and the first spacer 3 and the main spacer 2 are integrally formed. Two ends of the main spacer 2 are respectively connected to a first protector 21 and a second protector 22. The first protector 21 and the second protector 22 are respectively connected to the main spacer 2 at an angle. The first protector 21 and the second protector 22 are parallel to each other. In the embodiment, the first protector 21 is disposed under the main spacer 2. The first protector 21 has a curved outer peripheral surface which is located lower than the main spacer 2, and the second protector 22 has an outer surface with a triangular cross section which is disposed higher the main spacer 2.

Referring to the FIG. 1 again, the main spacer 2, the first protector 21 and the second protector 22 form a first channel 23, and the main spacer 2, the first protector 21 and the first spacer 3 forms a second channel 24, and the main spacer 2, the second protector 22 and the first spacer 3 form a third channel 25. The cable structure of the present invention includes a plurality of twisted pairs 4, each of the twisted pairs 4 includes an insulating material 41 and a core wire 42 enclosed by the insulating material 41. The first channel 23 is provided with an even number of twisted pairs 4, and the second channel 24 is provided with a single twisted pair 4, and the third channel 25 is provided another single twisted pair 4. The first protector 21 and the second protector 22 extend above a top of the main spacer 2 a first distance that is greater than a diameter of the plurality of twisted pairs 4, respectively. The first protector 21 and the second protector 22 extend below a bottom of the main spacer 2 a second distance that is greater than the diameter of the plurality of twisted pairs 4, respectively.

The first protector 21 and the second protector 22 respectively fix the twisted pairs 4 to the first channel 23, the second channel 24, and the third channel 25, respectively. When a plurality of the cable structure of the present invention are juxtaposed, the first protector 21 and the second protector 22 can block crosstalk interference caused by adjacent cables, thereby effectively improving the ability of external crosstalk, and at the same time, the main spacer 2 and the first spacer 3 further isolate the interference generated by the twisted pairs 4 respectively disposed in the first channel 23, the second channel 24, and the third channel 25, and signals in a plurality of core wires 42 of the twisted wires 4 disposed in the same channel respectively can complement each other.

A plurality of protrusions 11 are disposed on an inner surface of the tubular body and equally-spaced thereon. The protrusions 11 can enhance the prevention of the crosstalk between the adjacent cables.

Figure 2:
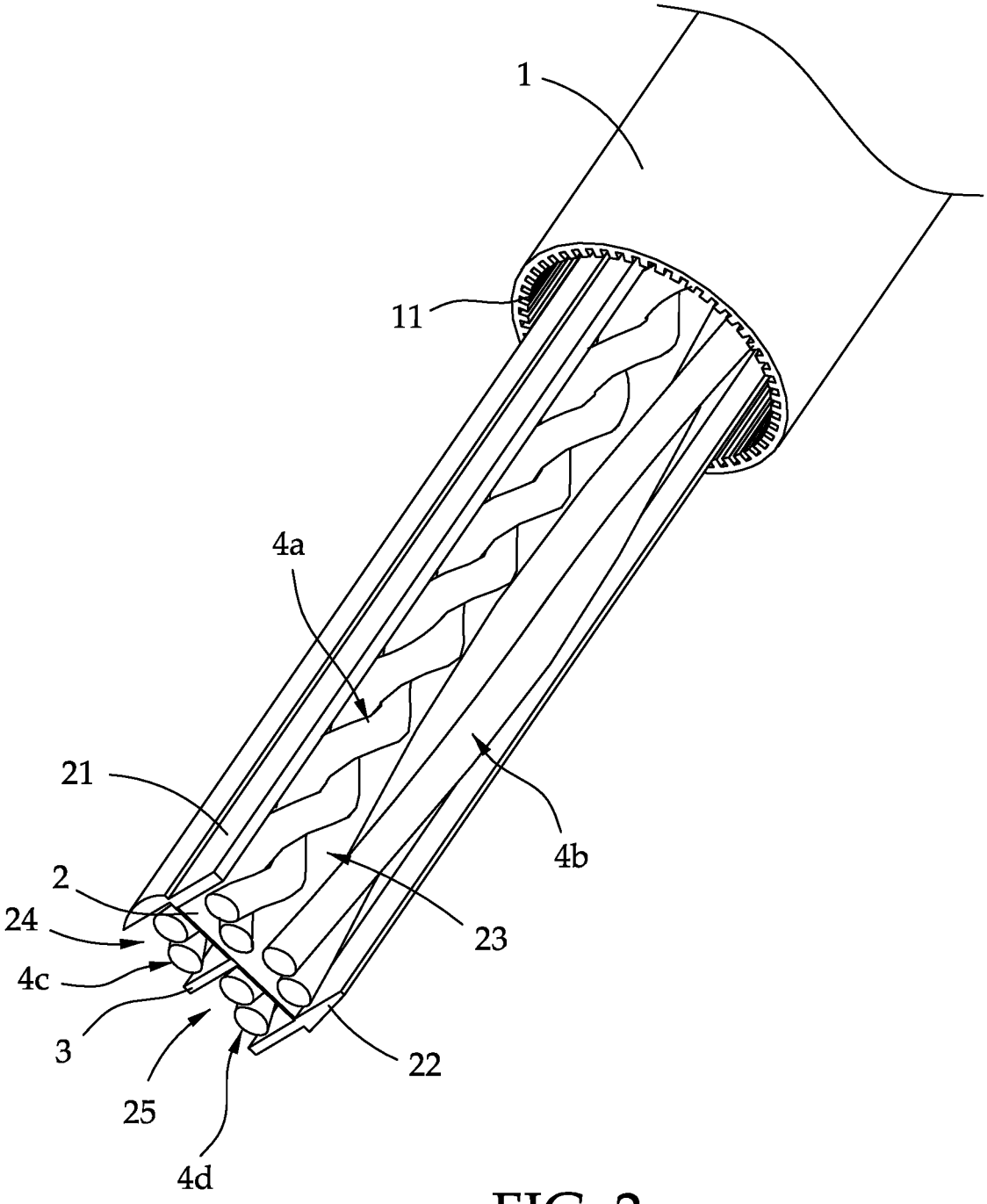
FIG. 2 is a perspective view of a second embodiment of a cable structure of the present invention.
Figure 3:
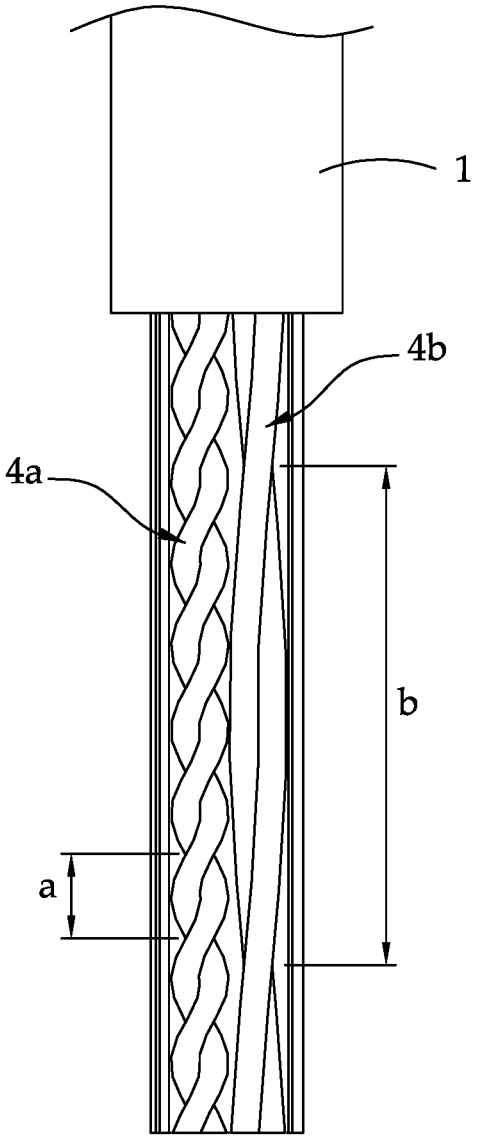
FIG. 3 is a bottom view of the second embodiment of a cable structure of the present invention.
Figure 4:
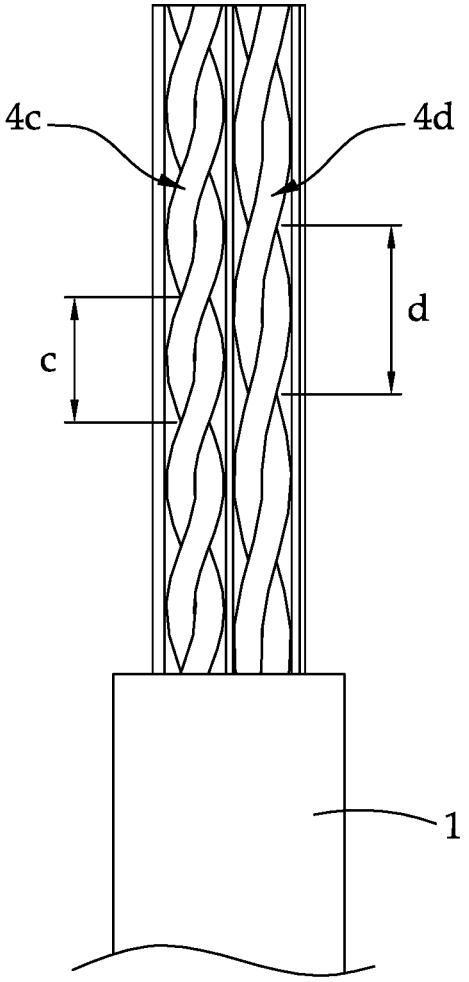
FIG. 4 is a top view of the second embodiment of a cable structure of the present invention.

Referring to the FIG. 2, which is a perspective view of a second embodiment of a cable structure of the present invention. As shown in FIG. 2, a first twisted pair 4*a* and a second twisted pair 4*b* are disposed in parallel in the first channel 23, a third twisted pair 4*c* is disposed in the second channel 24 and a fourth twisted pair 4*d* is disposed in the third channel, wherein the first twisted pair 4*a* has the longest pitch and the second twisted pair 4*b* have the shortest pitch respectively. As shown in FIG. 3, the pitch of a twisted pair 4*a* is a, and the pitch of the second twisted pair 4*b* is b. As shown in FIG. 4, the pitch of the third twisted pair 4*c* is c, and the pitch of the fourth twisted pair 4*d* is d. The value of the pitches of the twisted pairs has a correlation of b>d>c>a. The twisted pair 4*a* having the shortest pitch and the second twisted pair 4*b* having the longest pitch are adjacent to each other in the first channel 23 without spacing therebetween, so that the first twisted pair 4*a* and the second twisted pair 4*b* are signal complementary. The third twisted pair 4*c* having the second shortest pitch in the second channel 24 is separated from the second twisted pair 4*b* having the longest pitch by the main spacer 2, and away from the first twisted pair 4*a* having the shortest pitch, which can improve the complementary effect with the twisted pair having the longest pitch and reduce the interference with the twisted pair having the shortest pitch. Similarly, the fourth twisted pair 4*d* having the second longest pitch in the third channel 25 can improve the complementary effect with the twisted pair having the shortest pitch and reduce the interference with the fourth twisted pair 4*d* having the longest pitch.

Figure 5:
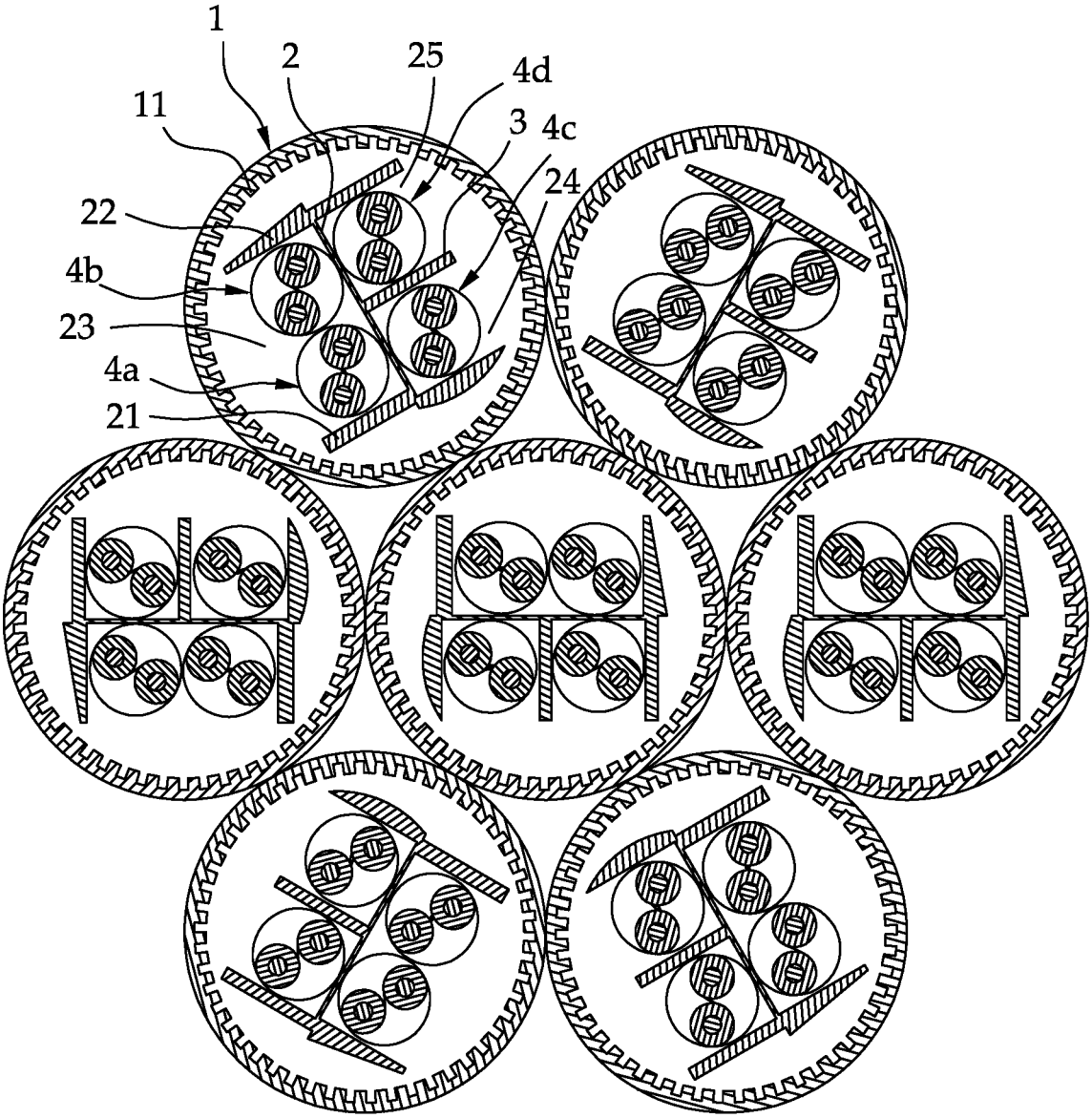
FIG. 5 depicts a use condition of a cable structure of the present invention.

In addition, as shown in FIG. 5, a combination of six cables surrounding one cable can simulate an environments on the site of a computer facility where several cables are joined. The central cable can prevent the electromagnetic interference caused by the externally surrounded cables through the first protector 21 and the second protector 22. In addition, further, the first protector has a curved shape and, and the second protector 22 has a triangular shape. The tip portion of the first protector 21 and the second protector 22 can match the shape of the tubular body 1 of the cable so as to cover a part of the twisted pairs therein to provide a more complete protection. The bottom portion of the first protector 21 and the second protector 22 opposite to the tip portion increases the distance between the twisted pairs and the external cable, thereby reducing the crosstalk therebetween. Further, the inner surface of the tubular body 1 is provided with a plurality of protrusions 11 equally spaced thereon. The protrusions 11 can maintain the twisted pairs 4 and the isolation bracket at a central region of the cable, thereby increasing the distance between twisted pair 4 and the other cables to reduce crosstalk.

Figure 6:
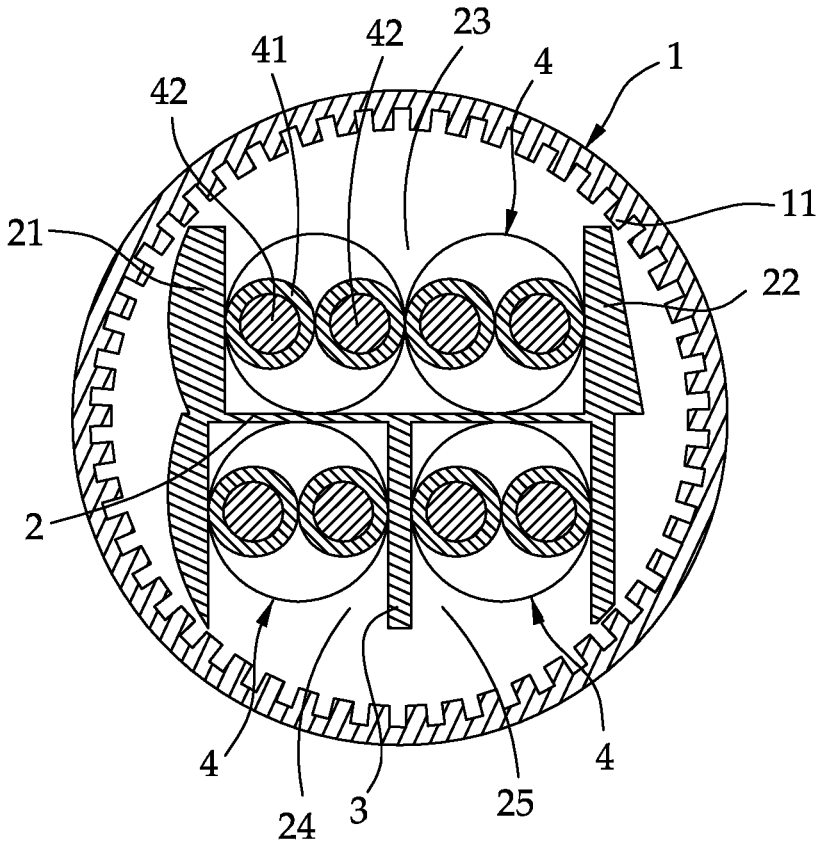
FIG. 6 is a cross-sectional view of a third embodiment of a cable structure of the present invention.

Referring to FIG. 6, in this embodiment, the first protector 21 has curved outer walls either higher or lower than the main spacer 2.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A cable structure, comprising:

a tubular body;

a main spacer disposed in the tubular body;

a first spacer disposed in the tubular body and substantially perpendicularly connected to the main spacer in a central position;

a first protector disposed at an end of the main spacer and connected to the main spacer at an angle;

a second protector disposed at another end of the main spacer and connected to the main spacer at an angle; wherein a first channel is formed by the main spacer, the first protector and the second protector, a second channel is formed by the main spacer, the first protector and the first spacer, and a third channel is formed by the main spacer, the second protector and the first spacer; and a plurality of twisted pairs disposed in the first channel, the second channel and the third channel, wherein an even number of the twisted pairs are received in the first channel, one of the twisted pairs is received in the second channel and another one of the twisted pairs is received in the third channel;

wherein the first protector and the second protector extend above a top of the main spacer a first distance that is greater than a diameter of the plurality of twisted pairs, respectively, and the first protector and the second protector extend below a bottom of the main spacer a second distance that is greater than the diameter of the plurality of twisted pairs, respectively.

2. The cable structure as claimed in claim 1, wherein the first spacer is integrated with the main spacer.

3. The cable structure as claimed in claim 1, wherein the first protector and the second protector are parallel.

4. The cable structure as claimed in claim 1, wherein the first protector has a curved outer wall disposed lower than the main spacer.

5. The cable structure as claimed in claim 1, wherein the second protector has an outer wall provided with a triangular cross section disposed higher the main spacer.

6. The cable structure as claimed in claim 1, wherein the first protector has a curved outer wall.

7. The cable structure as claimed in claim 1, wherein each of the twisted pairs has two core wires, and each of the core wire is enclosed by an insulating material, and the core wires enclosed by the insulating material are twisted to form the twisted pair.

8. The cable structure as claimed in claim 1, wherein a plurality of equally-spaced protrusions are disposed on an inner wall of the tubular body.

9. The cable structure as claimed in claim 1, wherein the twisted pair having the longest pitch and the twisted pair having the shortest pitch are received in the first channel.

10. The cable structure as claimed in claim 9, wherein the twisted pair having the second shortest pitch is received in the second channel.

11. The cable structure as claimed in claim 9, wherein the twisted pair having the second longest pitch is received in the third channel.

12. The cable structure as claimed in claim 1, wherein the angle between the first protector and the main spacer and the angle between the second protector and the main spacer have a range between 60° and 120°.

* * * * *